US009351562B2

(12) United States Patent
Orsini

(10) Patent No.: US 9,351,562 B2
(45) Date of Patent: May 31, 2016

(54) LIGHT, FOLDABLE AND PORTABLE STANDING DESK DEVICE

(71) Applicant: Jean-Francois Orsini, Washington, DC (US)

(72) Inventor: Jean-Francois Orsini, Washington, DC (US)

( * ) Notice: Subject to any disclaimer, the term of this patent is extended or adjusted under 35 U.S.C. 154(b) by 0 days.

(21) Appl. No.: 14/261,036

(22) Filed: Apr. 24, 2014

(65) Prior Publication Data

US 2015/0305491 A1 Oct. 29, 2015

(51) Int. Cl.
*A47B 3/00* (2006.01)
*A47B 3/06* (2006.01)

(52) U.S. Cl.
CPC .. *A47B 3/06* (2013.01); *A47B 3/002* (2013.01)

(58) Field of Classification Search
CPC ..... A47F 5/114; A47F 5/116; A47F 5/11; A47F 5/10; A47F 5/04; A47B 43/02; A47B 47/06; A47B 3/14; A47B 19/08; A47C 5/005
USPC ..... 108/115, 124, 128; 248/188.6, 152, 248/205.5, 206.3, 346.3; 297/440.12
See application file for complete search history.

(56) References Cited

U.S. PATENT DOCUMENTS 558,433 A * 4/1896 Stoddord ..... 248/152
899,383 A * 9/1908 Canniff ..... 108/124
3,215,323 A * 11/1965 Bonitt ..... 224/325
3,490,394 A * 1/1970 Crandall et al. ..... 108/115
3,566,808 A * 3/1971 Slate et al. ..... 108/157.14
3,714,908 A * 2/1973 Notko ..... 108/157.14
3,866,550 A * 2/1975 Geschwender ..... 108/157.14
4,630,861 A * 12/1986 Henschel ..... 297/44
5,119,745 A * 6/1992 Terry ..... 112/470.17
6,102,027 A * 8/2000 Tilby ..... 126/38
6,161,901 A * 12/2000 Avner ..... 297/440.12
6,206,473 B1 * 3/2001 Kondratiev ..... 297/440.1
2002/0189508 A1 * 12/2002 Todd ..... 108/115
2005/0045779 A1 * 3/2005 Nan ..... 248/133
2006/0249642 A1 * 11/2006 Mavis ..... A47B 91/005 248/346.3
2006/0278140 A1 * 12/2006 Chen ..... A47B 3/14 108/173

FOREIGN PATENT DOCUMENTS

FR 2739536 * 4/1997

* cited by examiner

*Primary Examiner* — Janet M Wilkens
(74) *Attorney, Agent, or Firm* — Chen-Chi Lin

(57) ABSTRACT

A device to set up on a regular work desk—and to extend such a regular work desk—so that the user can work standing up which is healthier than sitting down for extended periods of time as most the nation's work force does. The device has been especially designed for quick adoption in large corporations. The device is easily removable and foldable into a small volume. The device is composed of a foldable base on which is placed a flat top board, itself foldable. The base is configured in an series of elements articulated to form a multi-pointed star. Height adjusting feet are added. Board and base are made of light materials.

1 Claim, 4 Drawing Sheets

LIGHT, FOLDABLE AND PORTABLE STANDING DESK DEVICE

BACKGROUND OF THE INVENTION

1. Field of the Invention

The invention relates to a device to elevate the working surface of a person standing in front of a regular desk, said device being placed on that desk, so that the user can work in a standing position.

2. Discussion of the Prior Art

The present invention is the product of an analysis and effort to make the largest share of the population stand up in front of their desk.

The dangerous national trend of obesity has been related, to a great extent, to the sedentary position of a great percentage of the work force. Today 75% of the workforce works in a sedentary position which has been connected with obesity, hypertension, diabetes, cancer, kidney stones among other ailments. People who stand up and walk around burn more calories and are less likely to put on weight that those sitting down at their desk, all day long. Many efforts have been made to have people who work at a desk to stand up in front of their desk as they can lose an estimated 50 calories per hour more than when sitting down.

Corporations receive rebates from health insurance companies that provide insurance to their employees when steps are taken by management to offer health improvement programs which would improve the health of their employees and therefore reduce health maintenance expenses and costs to the insurance companies. Were standing desks widely provided and utilized in a company, the company is certain to benefit from such rebates.

To introduce a device for standing at one's desk successfully in an organization's location and ensuring that it would be adopted by a maximum of employees, a unit of the device should be provided to each stationary employee so that all the units together make a visual impact on their colleagues, employees being led to use the device under the peer pressure that would naturally ensue, especially in an open space workplace configuration. However, the device should also be at a very low cost for the HR department of the company to justify a company-wide distribution of units. Furthermore the device should be as little intrusive as possible. Employees would be able to set it up and use it if convinced that they can take it down and put it out of the way very easily when desired. Indeed they will reflect—especially during the learning period—that at times they would prefer to take down the device and sit down at their regular desk and rest. Therefore the device should be as light as possible and as foldable as possible, without losing effectiveness, providing a really adequate work surface and being genuinely stable.

Existing solutions for standing up desks and devices already exist which can be divided into four classes. The first class are devices which makes for whole desks to be raised. Those are bulky and very expensive devices. Secondly, standing desks also exist which are standing on the floor and, with cantilever mechanisms, raise the working surfaces from the ground to a level higher than regular desks. Such devices are now widely used in hospital and medical centers. Their working surfaces are usually quite small; their stability is a concern; their price is high and they are quite bulky if required to be set aside next to a regular desk when users feel the need to sit down at their regular desks. The third category are extended arms fixed on a regular desk that extend a small working area above the desk, and often require an extension platform for a mouse. Stability and price are still an issue there also. The fourth class are devices to be sitting on a regular desk, like the device under the invention, including a subclass designed as "lap desks" designed usually to work while sitting on a couch or sitting up on a bed. Their work space is also limited; either their footprint is too small to afford good stability for a acceptable working area or they are still too heavy with complex lifting mechanisms which makes them not conveniently portable nor foldable. They are also more costly to manufacture than the device under the invention. The device according to the invention can also be placed in an attaché case or a shoulder bag so that the user can have access to it even when changing desks and thus does not lose the habit of working standing up when away from his regular desk.

DESCRIPTION OF THE INVENTION

The device under the invention is divided in three groups of elements: the top board for working surface, the base and a lift adjustment mechanism. The device is manufactured out of a very light but sturdy material, including light wood such as bamboo, cardboard, corrugated plastic, or light metal or combination thereof. Only the third group of elements—the lifting mechanism—is not made out of the light materials.

The base is composed of 6, or possibly more, (but an even number) articulated quadrilateral section elements of equal width. All the section elements are connected on their equal side—with a flexible material or hinge—in line, to form a multi-pointed star as the section elements are articulated alternatively inward and outward. The overall base is then erected on the desk and moved to close on itself—end to end—and form a closed area. The two sections at the extremities (a first end base board section and a second end base board section) feature a closing mechanism to maintain the base closed. A plurality of mid-range base board sections are between the first end base board section and the second end base board section. The closing mechanism may be of different types, including a system of straps with a hook-and-loop fastening system.

The top board is constituted by a board with dimensions in the range, for example, of 24"×15" which is greater than any working surface of any device offered for the same purpose in similar purpose standing desks, save for configuration that provide for the whole desk to be lifted up. This board is cut in two or more sections, on one of its dimensions. These sections are connected—also with the same flexible material constituting a hinge as the components of the base—to allow this top board to be folded and unfolded at will.

Sections of the upper edges of the erected elements of the base are set with one part of a fastener of the hook-and-loop type (e.g. VELCRO), with the bottom of the top board affixed with the other part of the hook-and-loop type in order to maintain stability of the top board over the base. Special glues or magnets can also be used for that purpose.

A height-adjustment mechanism is constituted by a metal shaft inserted in an inwardly threaded spacer cylinder which will be affixed to the base element, or in an inwardly threaded cavity in the base material. Such mechanisms are fixed to the base elements at or near the place where these elements are articulated and at the lower part of these base elements where the base with make contact with the larger desk the device sits on, thereby working as feet to the whole device. A suction cup, or similar contraption, is fixed to the end of each shaft in order to provide a wider and more stable surface of contact with the desk the device is sitting on. Between the suction cup and the upper part of the shaft, an articulated ball joint allows again better contact with the surface on which the device according to the invention sits. Adjustment in the height of the device is therefore made by maneuvering the shafts up or down within their respected threaded cylinders or threaded cavities made in the base elements.

The sections of the base, as well as of the top board/working space, are folded flat and take a minimum volume when not in use.

The base could also be constituted by a contraption similar to a foldable banker's box. But, when flat, the banker's box would fold into a significantly larger surface than the device under the invention. It would be foldable but only made flat as its bulkiness will not be much reduced and would be too great which would not allow it to be easily portable. Also, when set up, the footprint of a banker's box would be too small to sustain a top board of the size made possible by the device under the invention which allows room for a laptop, a mouse and documents.

Figure 1:
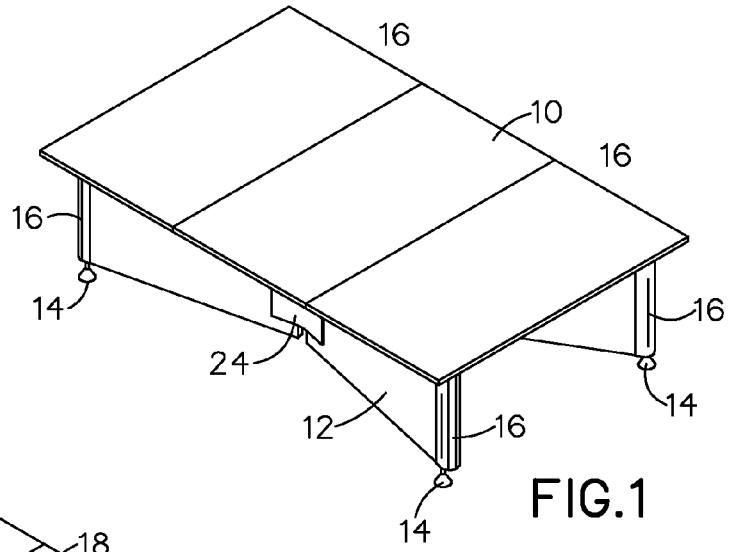
FIG. 1 is a perspective view of the whole device according to the invention, showing the work surface 10, the base 12, the adjustable suction feet 14, the hinges 16 and the hook-and-loop fastener closure straps 24.
Figure 2:
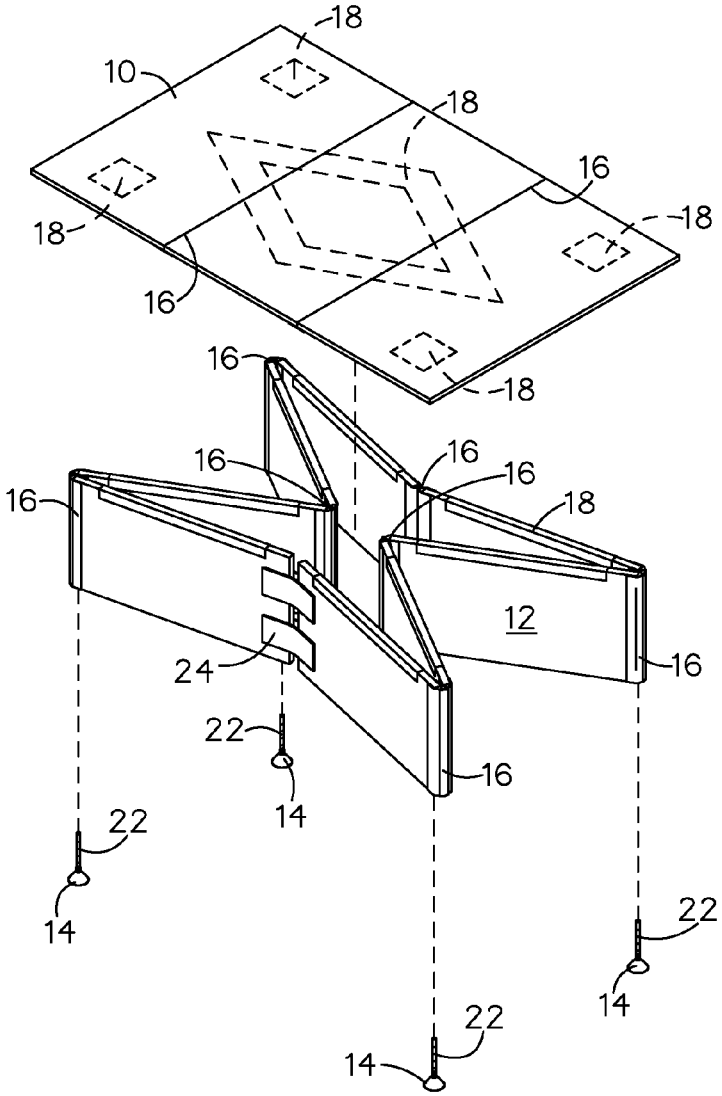
FIG. 2 is an exploded perspective view of the whole device with on top the work surface 10 detached from the base 12 showing the hinges between the foldable elements of this surface 16 and the hook-and-loop fastener sections 18 that are on the bottom of this work surface. Below, the base 12 is shown made of 8 elements articulated alternatively inward and outward. On the top of these elements are the opposite sections of the hook-and-loop fastener 18 that are to connect with the sections on the bottom of the work surface. The base is closed by fastener straps in 24. The height adjusting shafts 22 and the adjustable suction feet 14 are placed at each end of the base elements. The base closure straps 24 are also visible.
Figure 3:
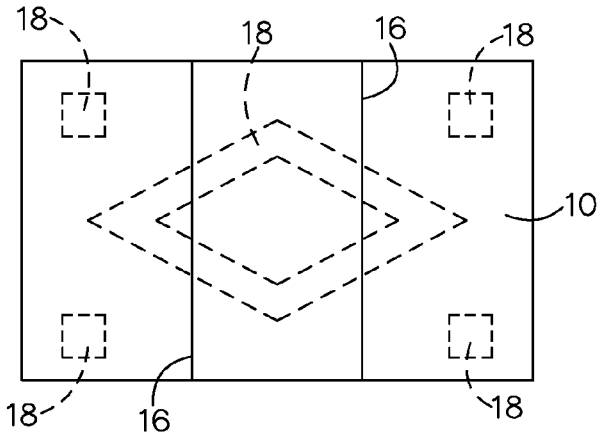
FIG. 3 is a top view of the invention showing the hinges 16 between the elements of the work surface 10 and the sections of the hook-and-loop fastener 18 that are below this work surface.
Figure 4:
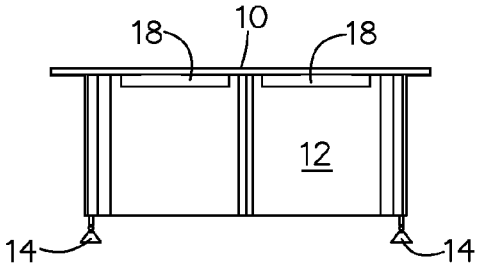
FIG. 4 is a side view of the invention. It shows the working surface 10 on top of the base 12 with the hook-and-loop sections 18 of the base making contact with the other type hoop-and-loop sections on the bottom of the working surface, and the adjustable suction cup feet 14.
Figure 5:
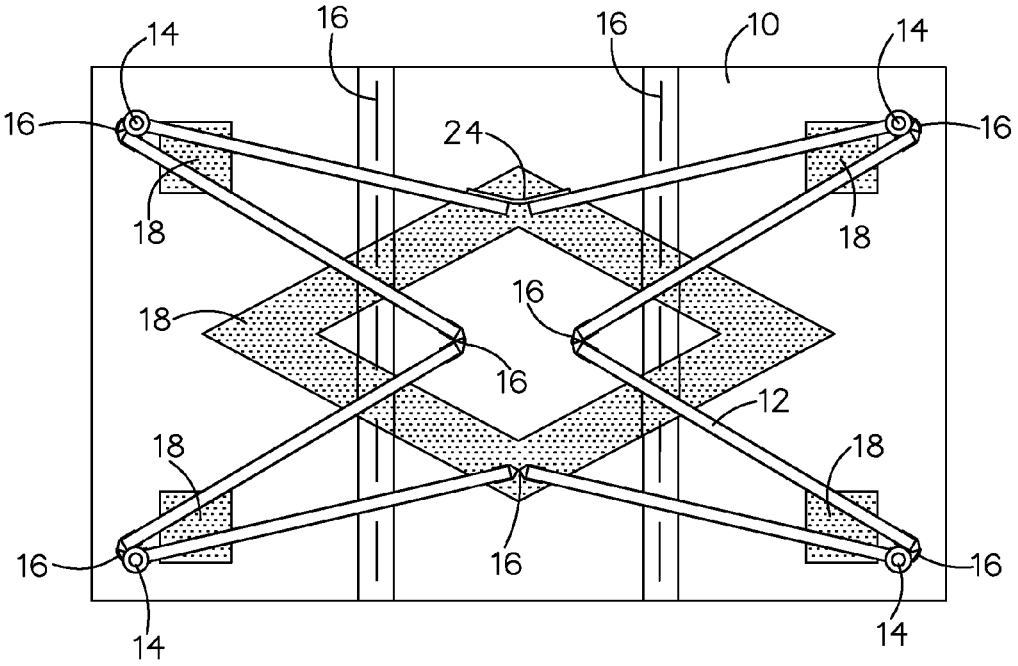
FIG. 5 is a bottom view of the invention showing the elements of the base 12 in contact with the working surface 10 by way of the hook-and-loop fasteners 18. The different elements of the base are articulated by the hinges 16. At the end of these elements the adjustable suction cup feet are in 14. The elements of the base are closed by hook-and-loop fastener 24.
Figure 6:
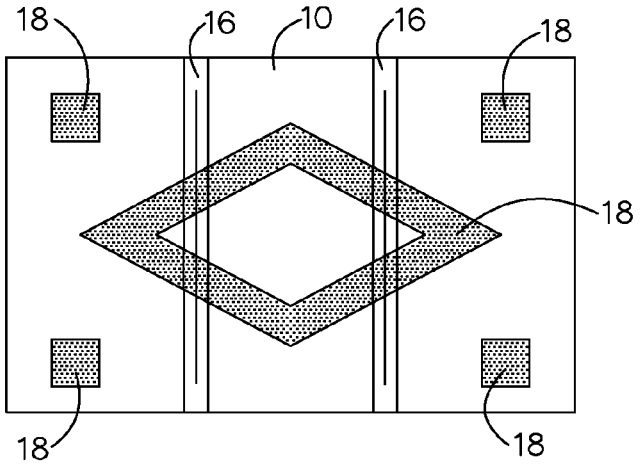
FIG. 6 is a bottom view of the work surface. I shows the work surface 10 and its three elements articulated by the hinges 16, as well as the hook-and-loop fasteners 18.
Figure 7:
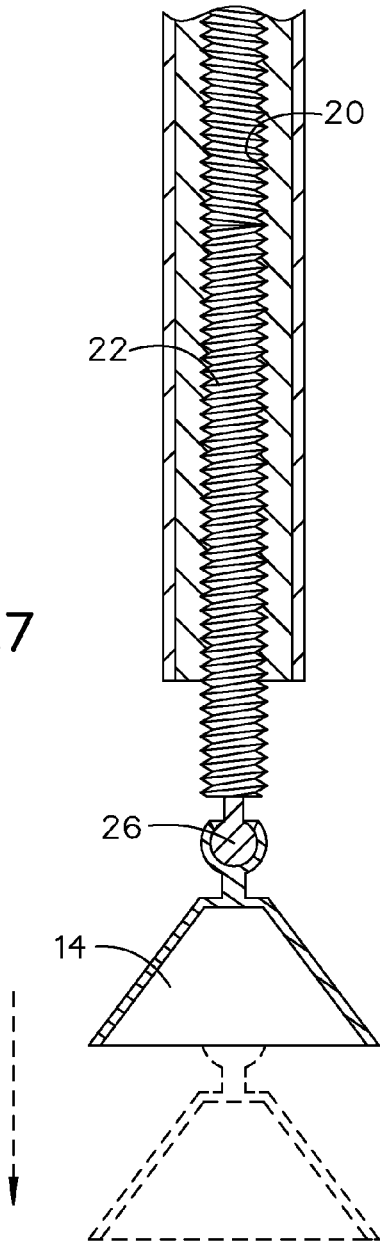
FIG. 7 is a detailed section view illustrating the adjustable leg. At the lower part is the adjustable suction cup feet 14 which are in contact with the larger desk on which the device according to the invention sits. The feet are connected to the height adjusting shaft 22 with an articulated ball joint 26. The shaft is inserted in the threaded hole 20.
Figure 8:
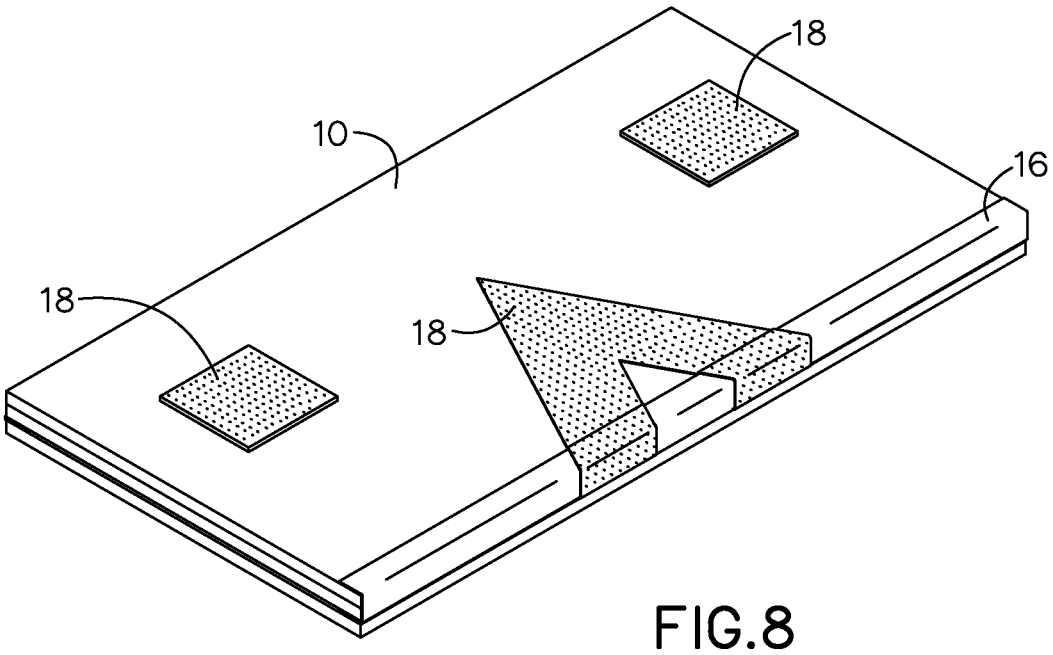
FIG. 8 is a perspective view of the collapsed top board or working surface 10, showing the hinges 16 articulating the elements composing this working surface and the hoop-and-look sections 18 underneath the working surface.
Figure 9:
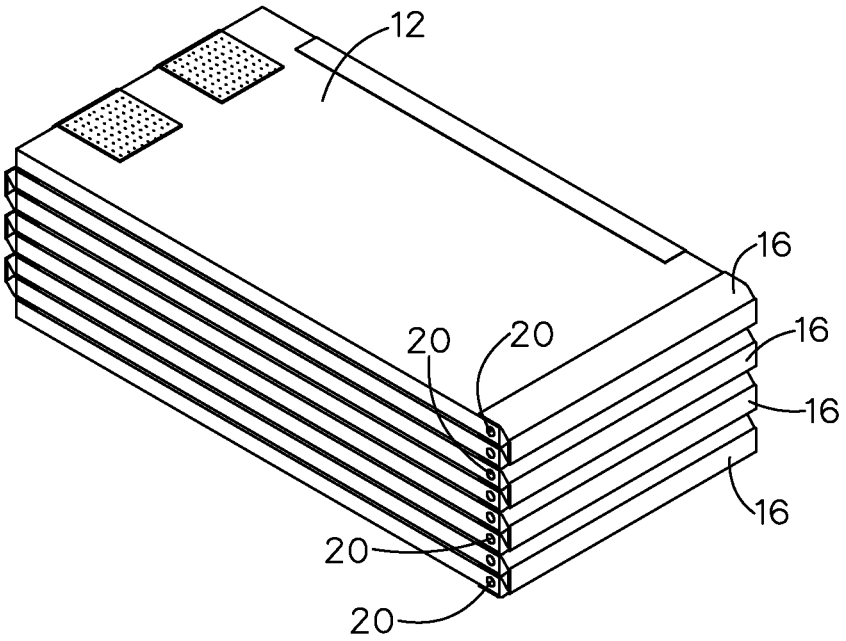
FIG. 9 is a perspective view of the collapsed base 12 showing the hinges 16 articulating the elements composing this base and the threaded holes 20 in which are inserted the feet.

What is claimed is:

1. A portable device comprising a foldable top board;

a base having a plurality of base board sections, the plurality of base board sections comprising a first end base board section;

a second end base board section; and a plurality of mid-range base board sections; and a plurality of feet connected to the base;

wherein the plurality of base board sections are of a same width and are of a same length;

wherein each of the plurality of mid-range base board sections is hingedly connected to a respective left side of base board section of the plurality of base board sections and a respective right side of base board section of the plurality of base board sections; and wherein the portable device is characterized by a compact condition in which the foldable top board and the base are collapsed and folded; and the plurality of mid-range base board sections are between the first end base board section and the second end base board section; and an expanded condition in which the foldable top board and the base are unfolded and expanded;

the first end base board section and the second end base board section are connected by straps;

the plurality of base board sections form an enclosure having a shape of a multi-pointed star; and the foldable top board is supported by the base.

* * * * *